US005174609A

United States Patent [19]

Tucker

[11] Patent Number: 5,174,609

[45] Date of Patent: Dec. 29, 1992

[54] COUPON DOCUMENT ENABLING A USER TO REVEAL ONE COUPON WHILE DESTROYING ANOTHER COUPON

[75] Inventor: Larry H. Tucker, Saddle River, N.J.

[73] Assignee: Larry Tucker, Inc., Woodcliff, N.J.

[21] Appl. No.: 767,857

[22] Filed: Sep. 30, 1991

[51] Int. Cl.[5] ..... B42D 15/00

[52] U.S. Cl. ..... 283/105; 40/539; 283/56; 283/903; 428/43; 428/916

[58] Field of Search ..... 40/539; 283/56, 105, 283/903; 428/43, 916

[56] References Cited

U.S. PATENT DOCUMENTS

| | | | |
|---|---|---|---|
| 3,524,782 | 8/1970 | Buske | 283/103 X |
| 3,734,544 | 5/1973 | Fishkin et al. | 283/56 |
| 4,318,235 | 3/1982 | Augeri | 283/81 X |
| 4,345,393 | 8/1982 | Price et al. | 283/81 X |
| 4,722,554 | 2/1988 | Pettit | 283/105 |
| 4,817,990 | 4/1989 | Krost | 283/101 |
| 5,052,718 | 10/1991 | Gold | 283/105 |
| 5,102,168 | 4/1992 | Golp | 283/105 |

*Primary Examiner*—Paul A. Bell
*Attorney, Agent, or Firm*—Burns, Doane, Swecker & Mathis

[57] ABSTRACT

A coupon document enables a user to reveal one of two coupons in a manner which causes the other coupon to be destroyed. The document comprises first and second panels held together along their outer peripheral edges by releasable glue. Each panel has a hidden inner side on which coupon indicia is imprinted. Each panel includes a pull strip which, when pulled off, destroys the coupon indicia on the respective panel while enabling the coupon indicia on the other panel to be revealed.

5 Claims, 2 Drawing Sheets

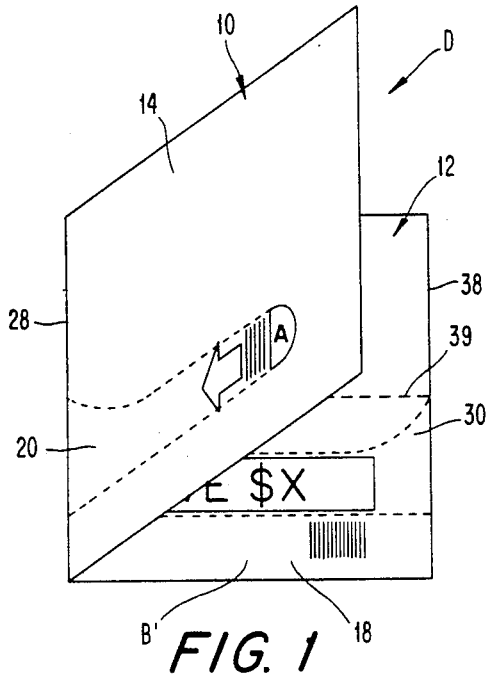
FIG. 1
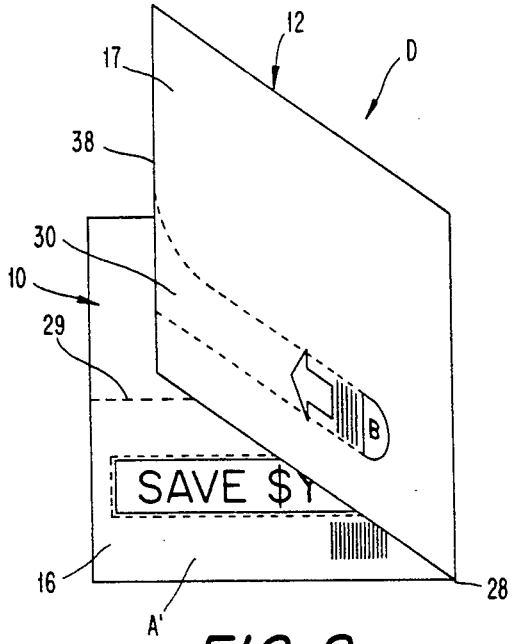
FIG. 2
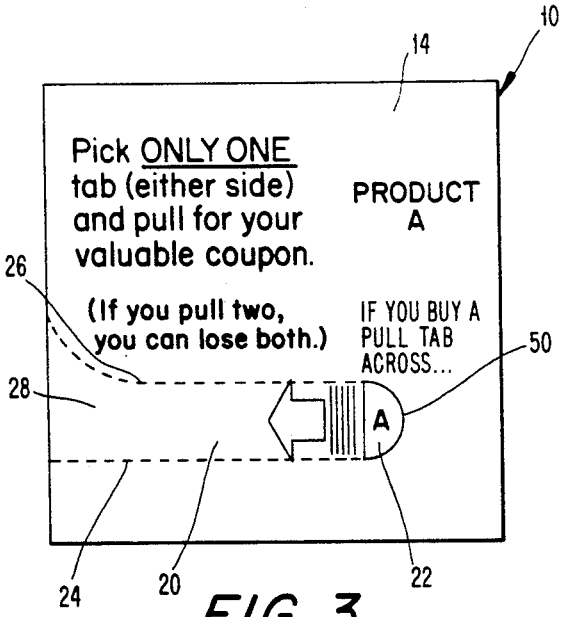
FIG. 3
FIG. 4
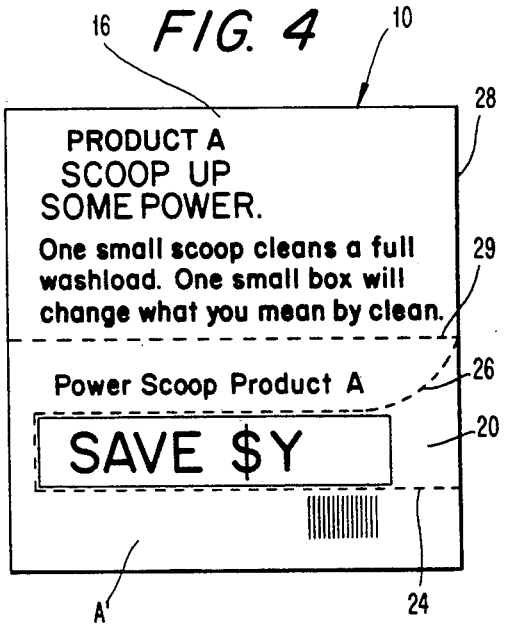

COUPON DOCUMENT ENABLING A USER TO REVEAL ONE COUPON WHILE DESTROYING ANOTHER COUPON

BACKGROUND OF THE INVENTION

This invention relates to retail coupon documents.

Previously proposed in Krost U.S. Pat. No. 4,817,990 is a retail coupon document in which two paper panels are glued together along their borders. Each panel thus presents a hidden side (which faces the hidden side of the other section) and an exposed side (which constitutes the front or rear side of the coupon document). Two coupons are imprinted on the exposed front side. Those document-opening instructions require the user to cut the panels along predefined overlapping division lines which are visible to the user on the exposed front side. The user is instructed to chose between two different division lines, depending upon whether the user is a user of the competitor's product or the sponsor's product. The user will reveal a coupon for the sponsor's product regardless of which division lines are chosen. However, the division lines presented to users of the competitor's product serve to destroy the lesser value coupon and reveal the greater value coupon, whereas the division lines presented to the user of the sponsor's product serve to destroy the greater value coupon and reveal the lesser value coupon.

The sponsor would issue or sponsor such a coupon document in order to target the users of the competitor's product and present them with an incentive for switching to the sponsor's product.

It is, however, an inconvenience for the user to have to use a scissors to make the necessary cut. Also, the presence of intersecting and overlapping division lines may cause confusion, resulting in the user accidentally cutting along the wrong lines.

A variation of the Krost coupon document has been previously proposed in which the coupon includes a means or tool for tearing along the division lines, namely, a pair of zipper pulls which are integral with a common one of the panels. Those zipper pulls which are defined by perforated lines, form manually actuable tools which effectively cut through one of the panels (but not the other panel) along the perforated division lines when pulled by the user. However, the presence of both pull tabs on the same panel may still lead to confusion on the part of the user. Also, after pulling one of the zipper pulls the user must still remove a portion of the sheet which contains the perforation lines of the other, nondestroyed coupon. Unless the user is careful, those division lines might inadvertently be severed, thereby destroying both coupons.

SUMMARY OF THE INVENTION

The present invention relates to a coupon document which enables a user to reveal one coupon while destroying another coupon. The coupon document comprises first and second panels which are removably joined together by an adhesive along their peripheral edges. The first panel includes a first outer side and a first inner side. The first inner side is imprinted with first indicia defining a first coupon. The first panel also includes a first pull strip defined by perforations in the panel. The first pull strip is accessible from the outer side to be manually pulled off. The first pull strip is located opposite indicia of the first coupon so that when the first pull strip is pulled off, the first coupon is destroyed. The second panel includes a second outer side and a second inner side. The second inner side faces the first inner side and is imprinted with second indicia defining a second coupon. The second panel also includes a second pull strip defined by perforations in the second panel. The second pull strip is accessible from the second outer side to be manually pulled off. The second pull strip is located opposite indicia of the second coupon so that when the second pull strip is pulled off, the second coupon is destroyed.

Preferably, each of the pull strips has an initial pull end which is spaced from all peripheral edges of its respective panel and extends all the way to one of the peripheral edges.

Each of the division lines are preferably parallel at a location adjacent the initial pull end and then diverge at a location adjacent a peripheral edge.

It is preferred that some of the indicia of the second coupon is arranged to be visible from a slot formed in the first panel once the first pull strip is pulled off, and that some of the indicia of the first coupon is arranged to be visible through a slot formed in the second panel once the second pull strip is pulled off.

Preferably, the slots which are formed in the panels in response to the pulling off of the pull strips are of a size sufficient to accommodate a user's finger so that the remainder of the respective panel can be peeled away from the other panel.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 1 is an exploded front perspective view of a coupon document according to the present invention before the panels thereof have been adhered together;

FIG. 2 is an exploded rear perspective view of the panels depicted in FIG. 1;

FIG. 3 is a view of an exposed outer side of a first panel before a pull strip thereof has been removed;

FIG. 4 is a view of a hidden inner side of the first panel before the pull strip thereof has been removed;

DETAILED DESCRIPTION OF A PREFERRED EMBODIMENT OF THE INVENTION

Depicted in FIGS. 1 and 2 is a coupon document D according to the present invention in an exploded perspective view. That document comprises first and second rectangular panels 10, 12 which are to be glued together along their four peripheral borders. The panels are formed of paper, and the glue is of a type enabling the panels to be later peeled apart by a coupon user without destroying the paper or damaging the printing thereon, e.g., the glue can be a type available from the National Starch Co. of Milburn, N.J.

Figure 5:
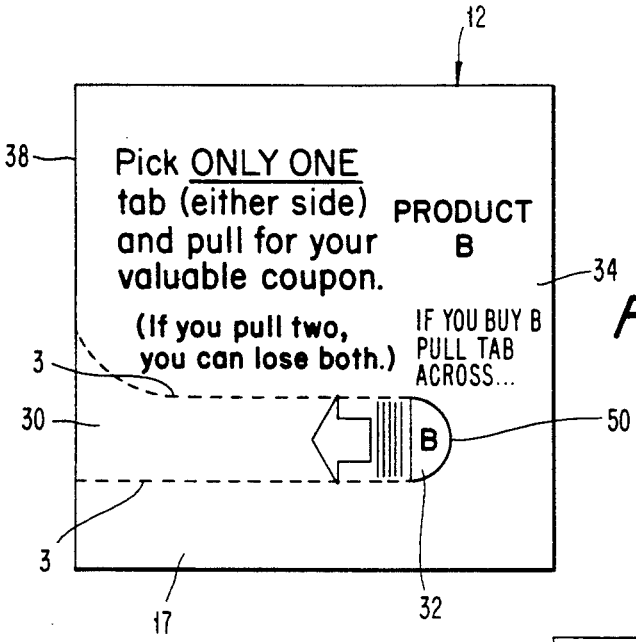
FIG. 5 is a view of an exposed outer side of a second panel of the coupon document before the pull strip thereof has been removed.

The first panel 10 includes an outer exposed side 14 depicted in FIGS. 1 and 3 and an inner side 16 depicted in FIGS. 2 and 4 (the inner side 16 being hidden from view once the panels have been glued together). The second panel 12 also has an pouter exposed side 17 (see FIGS. 2 and 5) and an inner hidden side 18 (see FIGS. 1 and 6), the latter facing the hidden side 16 of the first panel when the panels have been glued together.

The first panel 10 is provided with a first pull strip 20 having an initial pull end defined by an end tab 22 spaced from all peripheral edges of the panel 10. The first pull strip 20 is defined by a set of division lines 24, 26, each division line being formed by spaced perforations which extend through the first panel 10. The division lines 24, 26 extend generally parallel from the end tab 22 and eventually diverge as they reach an edge 28 of the panel 10.

FIG. 4 depicts the hidden side 16 of the first panel 10. Indicia defining a first coupon A′ is imprinted on that hidden side 16, which offers a particular value, e.g., a discount of Y dollars for the purchase of Product A. The first coupon A′ may occupy the entire side 16, or division lines may be provided, e.g., imprinted liens 29, which divide the first coupon A′ (located in the lower half of FIG. 4) from a message about product A (located in the upper half of FIG. 4).

The first pull strip 20 is located in the couponcontaining half of the first panel 10, i.e., opposite the indicia of the first coupon, such that the removal of the first pull strip 20 from the first panel 10 serves to destroy the first coupon A′ for purposes which will hereinafter become clear.

The second panel 12 is provided with a second pull strip 30 having an initial pull end defined by an end tab 32 which is spaced from all peripheral edges of the second panel 12. The second pull strip 30 is defined by a set of division lines 34, 36, each division line being formed by spaced perforations which extend through the first panel 30. The division lines 34, 36 extend generally parallel from the end tab 32 and eventually diverge as they reach a peripheral edge 38 of the panel 12.

The edge 38 coincides with the edge 28 when the panels 10, 12 are adhered together, but that need not be the case. That is, the second pull strip 30 could be arranged to be pulled from left to right instead of right to left.

Figure 6:
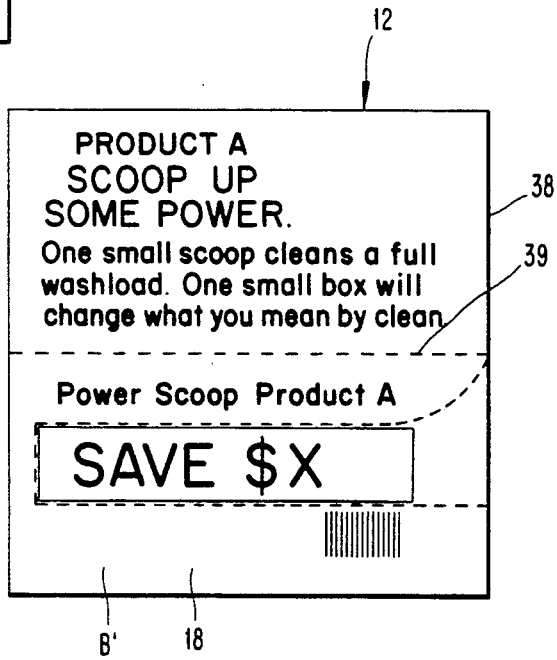
FIG. 6 is a view of a hidden inner side of the second panel before the pull strip thereof has been removed.

FIG. 6 depicts the hidden side 18 of the second panel 30. Indicia defining a second coupon B′ is imprinted on that hidden side 18, which offers a particular value different from the value of the first coupon A′. For example, the second coupon B′ could offer a second discount of X dollars for the purchase of product A. The second coupon B′ may occupy the entire side 18, or division lines may be provided (e.g., imprinted division lines 39 which divide the second coupon B′ (located in the lower half of FIG. 6) from a message about product A (located in the upper half of FIG. 6).

The second pull strip 30 is located in the couponcontaining half of the second panel 12, i.e., opposite the indicia of the second coupon, such that the removal of the second pull strip 30 from the second panel 30 serves to destroy the second coupon B′.

From the foregoing, it will be apparent that if a user pulls off the first pull strip 20, the latter will sever, and thus destroy, the first coupon A′, whereas the second coupon B′ will remain intact. Likewise, if the second pull strip 30 is pulled off, the second coupon B′ will be destroyed, and the first coupon A′ will remain intact.

Figure 7:
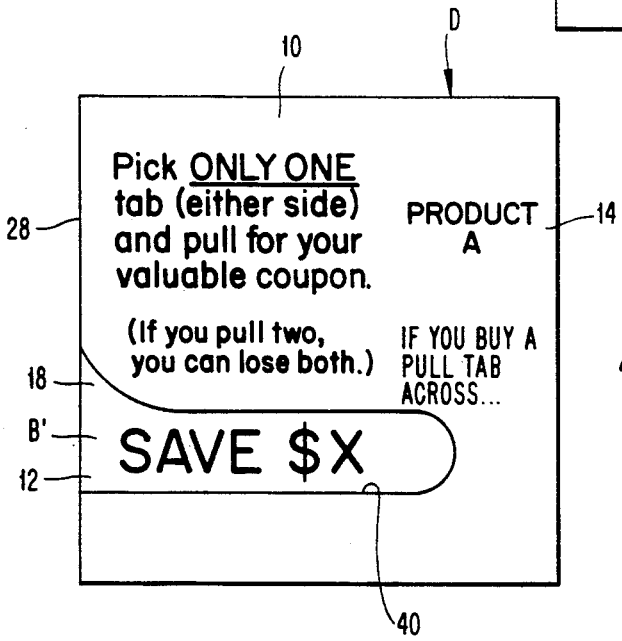
FIG. 7 is a view of the exposed outer side of the first panel after the pull strip of the first panel has been removed in order to reveal a coupon imprinted on the second panel.

Once the user pulls off one of the pull strips 20 or 30, a slot will be formed in the respective panel 10 or 12 which enables the user to insert his fingers to peel away the remainder of that panel so as to fully expose the previouslyhidden side of the other panel. For example, if the first pull strip 20 is pulled off as depicted in FIG. 7, a slot 40 is formed in the first panel 10 which enables the user to insert his or her fingers to separate the remaining portions of the first panel 10 from the second panel 12, thereby exposing the inner side 18 of the second panel (i.e., what the user now sees is depicted in FIG. 6). This can be done relatively easily due to the releasable nature of the adhesive which secures together the borders of the panels 10, 12.

Upon the removal of the first pull strip 20, a portion of the previously-hidden side 18 of the second panel 30 is exposed. Such an exposed portion could be the discount portion of the second coupon B′, for example which will induce the user to remove the remainder of the first panel 10. If desired, instructions can be imprinted on the exposed portion to instruct the user to remove the remainder of the panel. Alternatively, such instructions could be imprinted on the exposed sides of the panels.

It will be appreciated that only one of the two coupons A′, B′ can be revealed, since the revealing of one coupon results in the destruction of the other coupon.

Various types of offers can be made to the user, causing him to choose between the two pull strips 20, 30. For example, a manufacturer of product A may sponsor the distribution of a coupon document whose instructions direct a user of product A to reveal the second coupon B′, and direct a user of a competitor's product B to reveal the first coupon A′. Thus, regardless of which coupon is revealed, the user receives a discount for the purchase of product A. However, the user of the competitor's product, who reveals coupon A′, can receive a greater discount for the purchase of product A (i.e., amount Y being greater than amount X) in order to entice that user to switch to product A. That type of offer is merely exemplary; other types of offers and values could be made.

IN OPERATION, a user chooses one of the pull strips 20, 30 on the basis of the imprinted instructions. The user bends up the end tab 22 or 32 of the chosen pull strip. Such bending-up step can be facilitated by bordering the tab with a semi-circular preformed cut 50. The selected pull strip is then separated from its respective panel. If the first pull strip 20 was chosen (see FIG. 7), then the first coupon A′ will be destroyed, and the remainder of the first panel 10 will be removed to reveal the second coupon B′ as shown in FIG. 6.

Alternatively, if the second pull strip 30 was chosen, then the second coupon B′ will be destroyed, and the first coupon A′ will be revealed.

Since the division lines which form the first and second pull strips do not overlap, but rather are formed on respective first and second panels, the risk that the user will become confused and tear along the wrong division lines are reduced. Also, when the user removes the remainder of the coupon which carried the selected pull strip, there is little risk that the division lines on the other panel will be accidentally damaged, thereby ensuring the integrity of the selected (non-destroyed) coupon.

Although the present invention has been described in connection with a preferred embodiment thereof, it will be appreciated by those skilled in the art that additions, modifications, substitutions, and deletions not specifically described ma be made without departing from the spirit and scope of the invention as defined in the appended claims.

What is claimed is:

1. A coupon document enabling a user to reveal one coupon while destroying another coupon, comprising first and second panels removably joined together by an adhesive along their peripheral edges;

said first panel including:

a first outer side and a first inner side, said first inner side being imprinted with first indicia defining a first coupon, and a first pull strip defined by perforations in said first panel, said first pull strip being accessible from said first outer side to be manually pulled off, said first pull strip being located opposite indicia of said first coupon so that when said first pull strip is pulled off, said first coupon is destroyed, said second panel including:

a second outer side and a second inner side, said second inner side facing said first inner side and being imprinted with second indicia defining a second coupon, and a second pull strip defined by perforations in said second panel, said second pull strip being accessible from said second outer side to be manually pulled off, said second pull strip being located opposite indicia of said second coupon so that when said second pull strip is pulled off, said second coupon is destroyed.

2. A coupon document according to clam 1, wherein each of said first and second pull strips has an initial pull end spaced from all peripheral edges of its respective panel and extends all the way to one of said peripheral edges.

3. A coupon document according to claim 2, wherein said division lines of each pull strip are parallel at a location adjacent said initial pull end and diverge at a location adjacent said one peripheral edge.

4. A coupon document according to claim 1, wherein some indicia of said second coupon is arranged to be visible through a slot formed in said first panel once said first pull strip is pulled off, and some indicia of said first coupon is arranged to be visible through a slot formed in said second panel once said second pull strip is pulled off.

5. A coupon document according to claim 1, wherein said first and second pull strips form slots in the respective panels which are of a size accommodating a user's finger so that the remainder of the respective panel can be peeled away from the other panel.

* * * * *